United States Patent [19]

Staar

[11] 4,238,055

[45] Dec. 9, 1980

[54] POWERED ATOMIZER

[75] Inventor: Marcel J. H. Staar, Brussels, Belgium

[73] Assignee: Staar S.A., Brussels, Belgium

[21] Appl. No.: 32,898

[22] Filed: Apr. 24, 1979

[30] Foreign Application Priority Data

Apr. 26, 1978 [BE] Belgium ..... 886392

[51] Int. Cl.[3] ..... B67D 5/64

[52] U.S. Cl. ..... 222/162; 239/332

[58] Field of Search ..... 239/329, 332, 333; 222/333, 325, 326, 380, 383, 162, 183, 70

[56] References Cited

U.S. PATENT DOCUMENTS

| | | | |
|---|---|---|---|
| 3,952,916 | 4/1976 | Phillips | 222/162 X |
| 3,997,086 | 12/1976 | Shay | 239/333 X |
| 4,154,375 | 5/1979 | Bippus | 239/332 X |

FOREIGN PATENT DOCUMENTS

| | | | |
|---|---|---|---|
| 2223623 | 10/1974 | France | 222/162 |

*Primary Examiner*—Johnny D. Cherry
*Assistant Examiner*—Gene A. Church
*Attorney, Agent, or Firm*—Leydig, Voit, Osann, Mayer & Holt, Ltd.

[57] ABSTRACT

A powered atomizer that repeatedly actuates a conventional manual pump-type atomizer. The powered atomizer is a motor driven unit contained within a housing which holds the atomizer spray head and pump stationary, and provides a mechanism to reciprocate the atomizer container relative to the stationary spray head and pump to actuate the atomizer. The housing is comprised of two separable sections that permits disassembly of the housing and replacement of spent containers. The atomizer container is reciprocated in the housing by means of an electric motor with a motor shaft. The rotary motion of the motor shaft is transformed into reciprocating vertical translatory motion by a cam and follower mechanism. An on-off switch controls the supply of power to the motor, and the container returns to its lowermost position when the motor is stopped, so that it can be manually operated. Power to the motor can be supplied either by batteries within the housing or by a transformer within the housing that is connected to an external electrical source.

9 Claims, 5 Drawing Figures

FIG. 2A
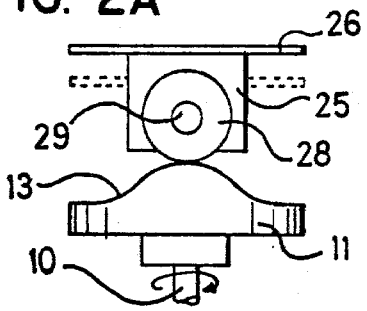
FIG. 2B
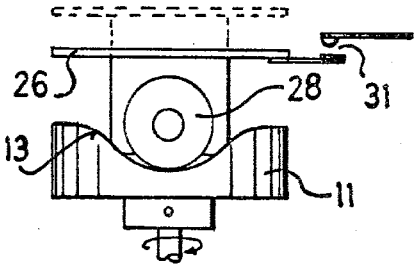
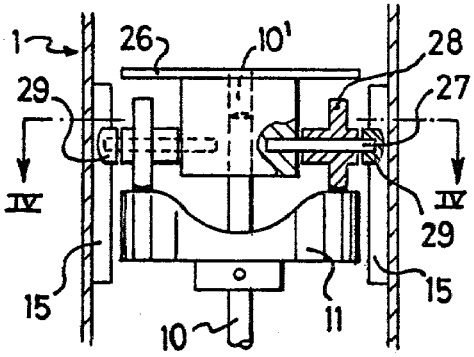
FIG. 3
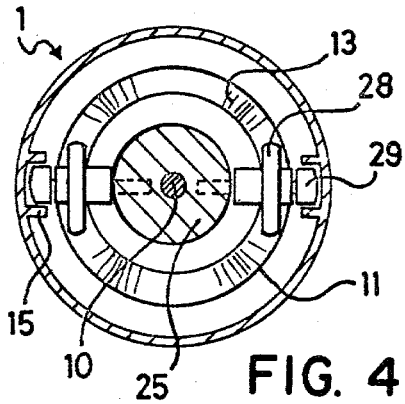
FIG. 4
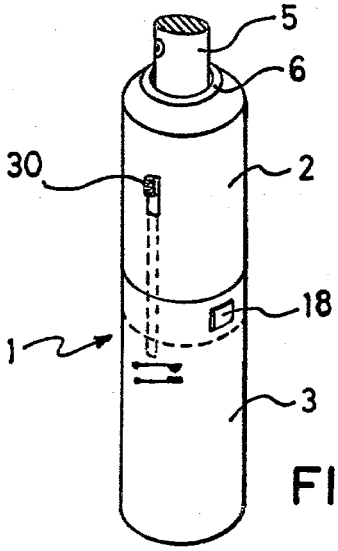
FIG. 5

POWERED ATOMIZER

This invention relates generally to devices for atomizing liquid and, more particularly, to improvements in mechanisms for atomizing liquid by means of a motor powered mechanism rather than manually.

Heretofore, for dispensing liquid in spray form from containers, it has been commonplace to place the contents under pressure and dispense using an aerosol valve. For energy saving and environmental reasons, conventional pump-type manual atomizers have now come into more widespread use than ever before and are being substituted for aerosol-type dispensing systems in many cases. Manual atomizers are, however, more difficult and inconvenient to operate than aerosol-type dispensers since conventional atomizers comprise a container for liquid to be atomized and a spray head and pump mounted on the container in such a manner that the atomizer spray head is required to be finger actuated each time it is desired to atomize liquid and spray it from the container.

This manual action of the atomizer spray head is tiring and difficult to sustain when the user decides to atomize and spray liquid for a prolonged period or at a fairly rapid rate, as when spraying hair lacquer or paint. It is very inconvenient to use such a manual atomizer when it is desired to aim the spray at a precise location, since the hand holding the atomizer at the desired level must also actuate the atomizer spray pump.

Moreover, when such manual atomizers are used to spray lacquer onto the hair, for example, they are found to be difficult to use, since the hand holding the atomizer is quite often in an awkward position preventing convenient manual actuation of the atomizer spray pump while properly aiming the spray.

The principle object of this invention is to overcome the problems previously encountered with manual atomizers, by providing a motor powered mechanism for operating a conventional, pump-type manual atomizer that permits a controllable spraying operation.

Another object is to provide a powered atomizer that is relatively simple and inexpensive to manufacture, using a conventional, pump-type manual atomizer rather than one of special design for atomizing liquid.

Another object is to provide a hand held powered atomizer that externally appears similar to spray cans of the aerosol type presently being marketed, and is attractive in appearance and convenient for the operator to use.

A related and more detailed object of this invention is to provide a powered atomizer in the form of a housing for receiving a conventional atomizer which comprises a container on which is mounted an atomizer spray head and pump, wherein the housing contains all the working elements of the power unit including the motor for actuating the atomizer spray pump.

Another object of this invention is to provide a power operated mechanism for actuating conventional pump-type manual atomizers, which has a mode of operation in which the container is moved relative to the atomizer spray head, rather than the spray head being movable relative to the container as is usual with manual atomizers.

It is a detailed object to provide a mechanism including a cam for converting the rotary motion of the motor shaft of the power mechanism to reciprocating translatory motion which is imparted to the container.

Another object is to provide a hand held powered atomizer having a housing formed of two parts that can be easily separated and assembled to allow a filled container to replace an empty container after its contents have been dispensed.

Another object of this invention is to provide a powered atomizer which may be operated manually when the motor switch is in the off position or when the motor is inoperative for any other reason.

This invention will be more fully understood from the following description of embodiments thereof, taken with reference to the accompanying drawings:

FIGS. 2A, 2B, 3 and 4 are detailed views relating to an alternative embodiment of rotary motion-transforming mechanism for a motor driven unit of the kind illustrated in FIG. 1;

FIG. 5 is an overall perspective view of the powered atomizer of FIG. 1.

Figure 1:
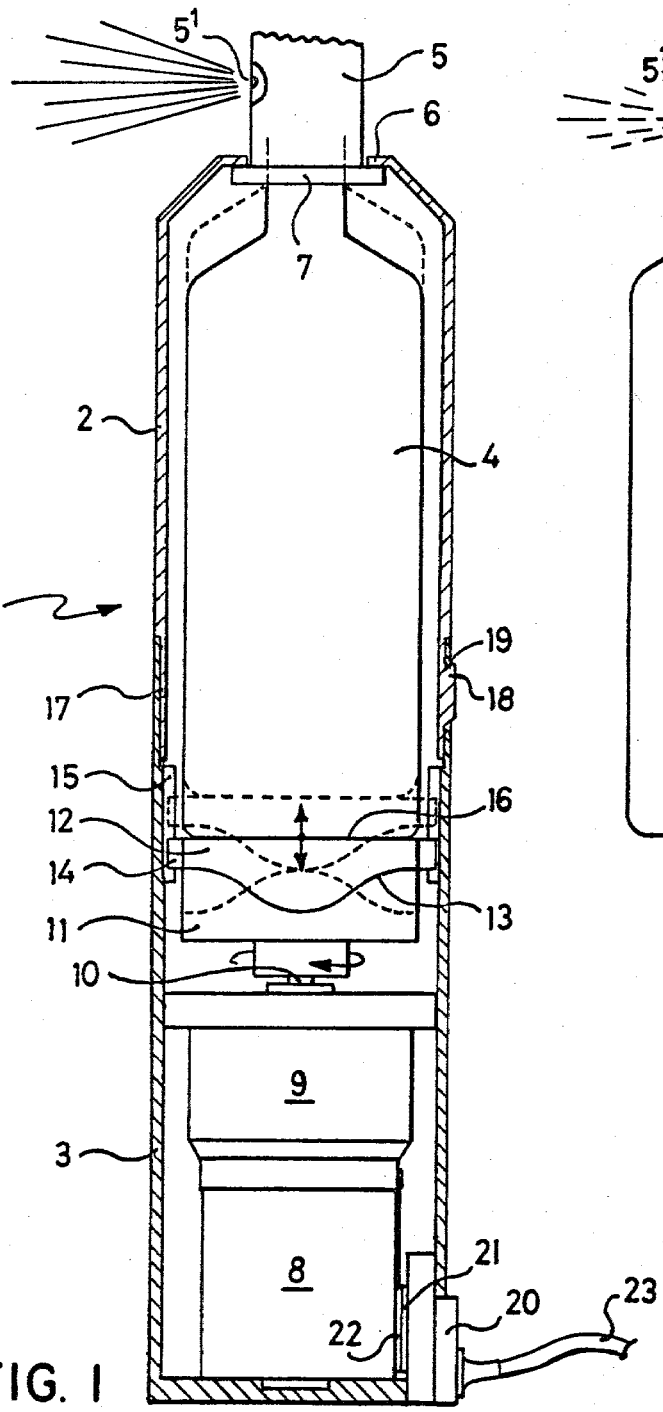
FIG. 1 is a vertical sectional view of a powered atomizer according to the invention, which includes a manual pump-type atomizer housed in a motor driven unit for actuating the manual atomizer.
Figure 1A:
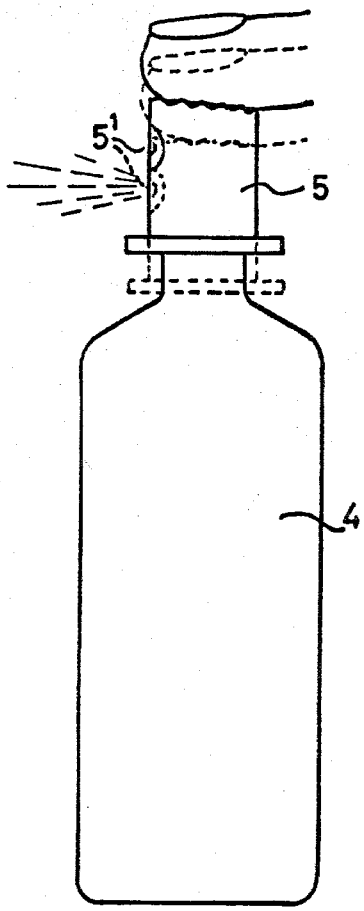
FIG. 1A is an elevational view of the conventional manual atomizer of FIG. 1, removed from the housing of the motor driven unit.

While the invention is suseptible to various modifications and alternative forms, two specific embodiments thereof have been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention.

DETAILED DESCRIPTION OF THE INVENTION

Turning to FIG. 1, a powered atomizer is shown having, in accordance with the invention, a housing 1, which comprises an upper section 2 and a lower section 3 which are separable from each other, and which contain all the elements of a power unit for operating a manual atomizer of the conventional pump-type mounted in the housing 1 and comprising a container 4 surmounted by a manually actuated spray head and pump 5 with an atomizing nozzle $5^1$.

For holding the spray head and pump 5 against outward movement, while allowing the spray head to be moved inward while the container 4 rests in a lower position in the housing 1, the housing 1 has at its upper end an opening through which the atomizer spray head and pump 5 projects, the housing having an inwardly directed rim 6 with which a collar 7 on the atomizer spray head and pump 5 comes into contact.

In keeping with the invention, the housing 1 includes in the lower section 3 of the housing 1 a motor 8 and drive means including a cam for moving the container 4 outward relative to the spray head and pump 5, herein shown as a speed-reduction gear train 9 coupling the motor to the output shaft 10, and a cam and follower mechanism for transforming the rotary motion of the shaft 10 into a reciprocating vertical motion of the container 4. In the embodiment shown in FIG. 1, the shaft 10 of the gear train 9 carries a crown cam 11 which is fixed to the shaft, and has an upward peripheral rim having a sinusoidal cam surface with two high points 13 on its peripheral rim. The follower 12 carries lateral projections 14 which project into spaces between two ridges 15 disposed vertically on the internal surface of the housing 1 and integral or fast with the housing and prevent rotation of the follower 12 when the cam 11 is rotated by the motor, but allow the follower 12 to reciprocate in the housing. To translate the container 4, the upper face of the follower 12 is flat and the base of the atomizer container 4 rests on the flat surface of the follower 12.

Thus, the cam 11 and follower 12 are relatively disposed and cooperate with one another in such a manner that when the shaft 10 and the cam 11 are rotated by the motor, the follower 12 and the atomizer container 4 receive a reciprocating downward and upward motion. When the high points 13 of the cam and follower surfaces are in contact, the container 4 is in its uppermost position in the housing 1 shown in dashed lines, and in moving to that uppermost position of the atomizer container 4 the atomizer pump 5 is actuted in a positive stroke which pumps liquid from the container and through the nozzle $5^1$. The high points 13 on the follower 12 move to the low points on the cam 11 as the cam rotates, allowing the atomizer container 4 to return to its lowermost position shown in solid lines in FIG. 1, due to the weight of the container 4 and the action of the return spring of the spray pump 5. As the container moves to that lowermost position the atomizer pump 5 is actuated in a return stroke.

The two sections 2–3 of the housing 1 are nested together at 17 and may be releasably locked together by one or more lugs 18 on one section which engage in corresponding cut-outs 19 in the other section of the housing.

For supplying the motor 8 with electrical power from the mains, a suitable transformer may be provided or batteries may be disposed adjacent the motor 8 in the lower section of the housing 1.

As shown, the motor 8 is connected to a source of electricity by a sliding plug 20 equipped with shoes 21 cooperating with contact strips 22 on the motor 8. A mains connecting lead is illustrated at 23.

For turning the motor on and off, a manually controlled switch 30 (FIG. 5) may be provided on the container in a suitable place for manipulation.

FIGS. 2A–2B, 3 and 4 illustrate another means which is particularly advantageous for transforming the rotary motion of the shaft 10 into reciprocating vertical motion of the atomizer container 4. A cam 11 similar to the cam 11 of FIG. 1 is fixed to the shaft 10. In this instance, the follower on the cam 11 is provided by a block 25 carrying at its upper end a plate 26, and laterally extending diametrically opposed stub shafts 27 which are coaxial. A roller 28 is mounted on each stub shaft 27 and contacts the sinusoidal cam surface of the cam 11.

The shaft 10 extends upwardly into the bore $10^1$ in the block 25, which bore serves as a guide for the shaft 10, and assists in guiding the follower in reciprocating movement in the housing 1. Each stub shaft 27 also carries a guide element 29 which is slidable in the space between two ridges 15 on the housing 1.

When the switch 30 controlling the electrical supply to the motor is actuated, the shaft 10 rotates at a speed of, for example, two revolutions per second, and drives the cam 11. The rollers 28, which follow the profile of the surface of the cam 11 since they are held by the guide elements 29, impart vertical reciprocating translational motion to the follower plate 26 on which the atomizer container 4 rests.

Because the rim 6 of the upper part 2 of the housing 1 retains the atomizer spray pump 5 by way of the collar 7, the atomizer spray head 5 is held against outward movement, and the atomizer container 4, due to its reciprocatory motion, imparts successive liquid atomizing actions in quick succession as long as the motor 8 is switched on.

When the switch 30 is turned off, the motor 8 stops and so does the reciprocating motion of the atomizer container 4. In accordance with an important feature of the invention, in both forms of the invention, the container 4 advantageously stops in a low position in the housing 1, in order that the atomizer spray pump 5 may be manually actuated at any time should there be a failure of the motor to operate for any cause, or in the case of use not requiring repeated atomization under power. The atomizer container 4 tends to stop in the lowermost position due to forces imparted against the cam 11 by the weight of the container and the return spring force of the return spring in the atomizer spray pump 5. These forces are transmitted by the follower, such that the momentum of the moving cam 11 and the motor and gear drive carry the cam 11 to a stop position where the follower is at rest in the low points of the cam 11. The forces transmitted from the follower to the cam 11 rotate the motor 8 through the gear train 9, until the motor connects to rest with the follower in the low points of the cam 11, the gear train 9 being a reversible drive to achieve this desired result.

To guarantee the container comes to rest in the lowermost position, an electrical contact 31 may be provided, linked to the plate 26 and which comes into action after the switch 30 has been turned off, cutting off the supply of electricity to the motor 8 when the container reaches the low position.

Thus it is apparent that there has been provided, in accordance with the invention, a powered atomizer that fully satisfies the objects, aims, and advantages set forth above.

I claim as my invention:

1. In a power unit for operating a manual atomizer comprised of a container with spray head and pump mounted on the container, by reciprocating said container relative to the spray head and pump, the improvement comprising:

a housing for said container having an opening for said spray head to project outward and be operable manually from the outside of said housing to actuate said spray pump, means on said housing adjacent said opening cooperating with means on said spray head to hold said spray head against outward movement while allowing it to be moved axially inward to actuate the spray pump when said container is resting in a lowered position in said housing, an electrically operated motor within said housing, drive means including a cam for converting rotary motion of said motor to reciprocating motion and to impart said reciprocating motion to move said container between lowered and raised positions in said housing to actuate said spray pump and spray liquid from the container, and an on-off switch for controlling the supply of electrical power to said motor in said housing and the duration of actuation of said spray pump under power.

2. In a power unit for operating a manual atomizer comprised of a container with spray head and pump mounted on the container, by reciprocating said container relative to the spray head and pump, the improvement comprising:

a housing for said container, means on said housing cooperating with means on said spray head to hold said spray head against outward movement while allowing it to be moved axially inward to actuate the spray pump when said container is resting in a lowered position in said housing, said means on said spray head including a collar fixed to the atomizer spray head and located adjacent to one end of said container, and said means on said housing including a rim on the upper end of said housing engaging said collar on said spray head, an electrically operated motor within said housing, drive means including a cam for converting rotary motion of said motor to reciprocating motion and to impart said reciprocating motion to move said container between lowered and raised positions in said housing to actuate said spray pump and spray liquid from the container, and an on-off switch for controlling the supply of electrical power to said motor in said housing and the duration of actuation of said spray pump under power.

3. In a power unit for operating a manual atomizer, the improvements according to claim 1 wherein said housing includes two sections which can be taken apart and reassembled to permit replacement of the manual atomizer.

4. In a power unit for operating a manual atomizer, the improvements according to claim 1 wherein said drive means is reversible and said motor is urged to a stop position with the container resting substantially in the lowermost position in the housing when said motor is turned off, to allow manual actuation of the atomizer spray pump.

5. In a power unit for operating a manual atomizer comprised of a container with spray head and pump mounted on the container, by reciprocating said container relative to the spray head and pump, the improvement comprising:

a housing for said container, means on said housing cooperating with means on said spray head to hold said spray head against outward movement while allowing it to be moved axially inward to actuate the spray pump when said container is resting in a lowered position in said housing, an electrically operated motor within said housing, drive means for converting rotary motion of said motor to reciprocating motion and to impart said reciprocating motion to move said container between lowered and raised positions in said housing to actuate said spray pump and spray liquid from the container, said drive means including a crown cam having a substantially sinusoidal cam surface, and a cam follower mounted for reciprocating movement and held against rotation and having a similar sinusoidal surface which cooperates with the sinusoidal cam surface of the crown cam to impart a reciprocating motion to the follower, said follower having another surface which engages the base of an atomizer container in the housing, and an on-off switch for controlling the supply of electrical power to said motor in said housing and the duration of actuation of said spray pump under power.

6. In a power unit for operating a manual atomizer, the improvements according to claim 1 wherein said drive means for converting the rotary motion of said motor includes a crown cam having a substantially sinusoidal cam surface, and a cam follower mounted for reciprocating movement and held against rotation and engaging the cam surface of the crown cam to impart a reciprocating motion to the follower, said follower having another surface which engages the base of an atomizer container in the housing.

7. In a power unit for operating a manual atomizer, the improvements according to claim 1 wherein said drive means for converting the rotary motion of said motor includes a crown cam having a substantially sinusoidal cam surface, and a cam follower mounted for reciprocating movement and held against rotation and having a pair of rollers contacting said sinusoidal cam surface of said crown cam, means for supporting said rollers including a diametrically opposed stub shaft, a block supporting said stub shaft, an upper plate on said block having a surface which engages the base of an atomizer container in the housing, each stub shaft carrying a guide element slidably engaged with guides provided by said housing and holding said cam follower against rotation.

8. In a power unit for operating a manual atomizer, the improvements according to claim 1 wherein said drive means is reversible and said motor is urged to a stop position with the container resting substantially in the lowermost position in the housing when said motor is turned off, to allow manual actuation of the atomizer spray pump.

9. A hand-held powered atomizer comprising:

a manual pump-type atomizer including a container and an atomizer spray head and pump mounted on said container, a power unit for operating said manual atomizer, said power unit having a housing for said atomizer container having an opening for said spray head to project outward and be operable manually from the outside of said housing to actuate said spray pump, means on said housing adjacent said opening for holding said atomizer spray head against outward movement, and means including motor means and drive means in said housing for moving said atomizer container outward relative to said spray head to actuate the atomizer pump under power to pump liquid from the container and dispense through the spray head.

* * * * *